United States Patent [19]

Alway

[11] Patent Number: 4,532,415

[45] Date of Patent: Jul. 30, 1985

[54] NUMBER WHEEL COUNTERS

[75] Inventor: Peter Alway, Bushey, England

[73] Assignee: Mecom Standard Limited, London, England

[21] Appl. No.: 279,987

[22] Filed: Jun. 23, 1981

[51] Int. Cl.[3] ..... G06C 25/00

[52] U.S. Cl. ..... 235/131 R; 235/133 A; 235/142; 235/144 ME; 377/30; 377/92

[58] Field of Search ..... 235/131 R, 133 A, 135, 235/139 R, 142, 143, 144 HC, 144 ME, 144 TP; 377/30, 92

[56] References Cited

U.S. PATENT DOCUMENTS

| | | | |
|---|---|---|---|
| 2,522,734 | 9/1950 | Wood | 377/92 |
| 3,306,537 | 2/1967 | Zeitlin | 235/131 R |
| 3,441,210 | 4/1969 | Moore et al. | 235/139 R X |
| 3,494,549 | 2/1970 | Spath | 235/144 HC X |
| 3,619,577 | 11/1971 | Hoffman | 377/92 |
| 3,761,015 | 9/1973 | Cook | 377/30 X |
| 4,250,404 | 2/1981 | Yamamoto et al. | 377/92 X |

FOREIGN PATENT DOCUMENTS

| | | |
|---|---|---|
| 334980 | 3/1921 | Fed. Rep. of Germany . |
| 840622 | 6/1952 | Fed. Rep. of Germany . |
| 241170 | 7/1965 | Fed. Rep. of Germany . |
| 1234070 | 2/1967 | Fed. Rep. of Germany . |
| 1233639 | 2/1967 | Fed. Rep. of Germany . |
| 2128033 | 12/1972 | Fed. Rep. of Germany . |
| 2422951 | 11/1975 | Fed. Rep. of Germany . |
| 1488725 | 7/1967 | France . |
| 294 | 1/1907 | United Kingdom . |
| 504710 | 4/1939 | United Kingdom . |

*Primary Examiner*—Benjamin R. Fuller
*Attorney, Agent, or Firm*—Kirschstein, Kirschstein, Ottinger & Israel

[57] ABSTRACT

An electrical impulse operated number wheel counter with coaxial number wheels (2); transfer pinions (8); a reciprocable pawl (12) engaging the first number wheel and a solenoid (20) driving the pawl, has a series of leaf springs (33) carried on the solenoid armature (24). In the rest position the leaf springs (33) engage bosses (9) on the transfer pinions to ensure that the number wheels (2) are correctly aligned but when the solenoid (20) is energized to effect a count, the movement of the armature (24) lifts the leaf springs away from the transfer pinions (8) which therefore rotate unhindered. An additional effect of the leaf springs is to reduce the power consumption of the counter and this effect can still be achieved with other spring arrangements. A shock resistance element (50) is freely rotatably mounted in the path of the pawl (12) so as to be struck in the event of shock induced movement of the pawl, substantially to eliminate spurious shock induced counts.

9 Claims, 5 Drawing Figures

NUMBER WHEEL COUNTERS

This application relates to counters and particularly to counters comprising a plurality of coaxial number wheels; transfer pinions respectively disposed intermediate successive number wheels, each pinion meshing with gear teeth on one of the number wheels adjacent thereto and adapted to engage transfer means on the other number wheel during rotation of said other number wheel thereby partially to rotate said one of the number wheels and drive means intermittently actuable to rotate a first one of the number wheels thereby to effect counting of the counter.

In such counters the angular position of the number wheels in the rest position—that is to say between counts—is determined in the case of the first number wheel by the ratchet or other drive means and in the case of the remaining number wheels by the engagement of successive number wheels with the transfer pinion disposed between them. Inevitably, necessary clearances and manufacturing tolerances lead to play in the engagement between transfer pinion and number wheel and since the transfer pinions are freely rotatable, this play is cumulative as one proceeds along the sequence of number wheels. In practice, the engagement of the first number wheel with the drive means will adequately locate the first number wheel in the rest position of the counter, but the error in alignment of the remaining wheels - particularly the higher order wheels -is significant and may in certain cases amount to one half of a digit. This mis-alignment leads to a ragged appearance of the display and may even result in misreading of the displayed number.

It has been proposed - in for example OE-PS No. 241170; US-PS No. 2,522,734; DAS No. 1 234 070 and FR-PS No. 1.488.725 to deal with the problem of alignment by providing leaf springs in continuous engagement with shaped bosses or other projections on either the number wheels or the transfer pinions, but this approach increases the operating power requirement of the counter and may result in noisy operation.

It is an object of one form of this invention to provide an improved counter in which such disadvantages are overcome.

Accordingly, one form of the present invention consists in a counter comprising a plurality of coaxial number wheels; transfer pinions respectively disposed intermediate successive number wheels, each pinion meshing with gear teeth on one of the number wheels adjacent thereto and adapted to engage transfer means on the other number wheel during rotation of said other number wheel thereby partially to rotate said one of the number wheels; drive means intermittently actuable to rotate a first one of the number wheels thereby to effect counting of the counter and alignment means disposed in a rest position to engage at least the last number wheel or a transfer pinion in mesh therewith, therby to align the number wheels, characterised in that the alignment means is momentarily displaced from said rest position upon actuation of the drive means to enable unhindered rotation of the number wheels during counting.

Preferably, the alignment means comprises leaf spring means carried upon a reciprocating element of the drive means.

Advantageously, the alignment means is arranged in a rest position to engage each number wheel or a transfer pinion in mesh therewith, thereby separately to align the number wheels.

Suitably, the transfer pinions include respective integral bosses formed with flats equal in number to the number of discrete angular positions adopted by the transfer pinions, said leaf spring means comprising separate leaves respectively engaging the flats.

In one form of the invention, the drive means includes a solenoid and a reciprocating armature, the leaf spring means being carried on said armature.

In the case of an electric impulse operated counter, the provision of leaf spring means carried on the armature and engaging either the transfer pinion or the number wheels has - aside from the alignment of number wheels—the important and unexpected benefit of reducing the power consumption of the counter. This beneficial result could, in cases where alignment of the number wheels is considered to be of less importance or where great care has been taken to reduce manufacturing tolerances and thus minimise the possibilities of mis-alignment, equally be achieved through engagement of the leaf spring means with parts of the counter other than the transfer pinions or number wheels. Accordingly, the present invention consists in another form in an electric impulse operated counter comprising a plurality of coaxial number wheels; transfer pinions respectively disposed intermediate successive number wheels, each pinion meshing with gear teeth on one of the number wheels adjacent thereto and adapted to engage transfer means on the other number wheel during rotation of said other number wheel thereby partially to rotate said one of the number wheels; reciprocally movable pawl means adapted when actuated to rotate a first one of the number wheels to effect counting of the counter and electrical impulse actuated means having a solenoid, an armature supported for reciprocal movement and engaging the pawl means to effect reciprocal movement thereof when an electrical impulse energizes the solenoid and spring means serving to return the armature to a rest position when the solenoid is de-energized, characterised in that there is provided spring means cooperating between the armature and a part of the counter so as to be stressed upon said return movement of the armature, energy in said stressed spring means assisting in movement of the armature when the solenoid is next energized.

Preferably, the spring means is leaf spring means carried on the armature.

It is a problem in certain applications with counters such as those considered above, that shock forces acting upon the counter may result in spurious counts. A number of proposals have been made to deal with this problem and to produce "shock-proof" counters, but these proposals in general have had the effect of increasing the power consumption of the counter. It is an object of yet a further form of this invention to provide an improved counter in which shock induced counting is inhibited by means which do not significantly increase the power consumption of the counter.

Accordingly, the present invention consists, in a further form, in a counter comprising a plurality of coaxial number wheels; transfer pinions respectively disposed intermediate successive number wheels, each pinion meshing with gear teeth on one of the number wheels adjacent thereto and adapted to engage transfer means on the other number wheel during rotation of said other number wheel thereby partially to rotate said one of the number wheels and drive means intermittently actuable to effect counting of the counter, characterised in that there is provided a shock resistance member freely movable relative to an element of the drive means and so positioned as to oscillate freely in the path of said element in the event of a shock tending to cause said reciprocal movement of the element, the shock resistance member thereby serving to interfere with shock induced movement of the element to inhibit shock-induced operation of the counter.

Advantageously, the drive means includes reciprocally movable pawl means and the shock resistance member is positioned as to oscillate freely in the path of said pawl means.

Suitably, the shock resistance member is eccentrically mounted for oscillatory movement about an axis parallel to the axis about which the pawl means is reciprocally movable.

The invention will now be described, by way of example, with reference to the accompanying, somewhat diagrammatic, drawings, in which:-

Figure 1:
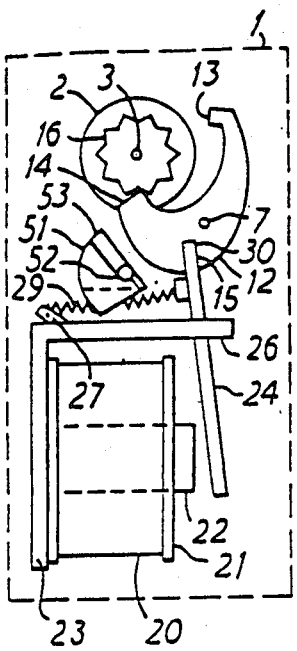
FIG. 1 is a side elevation of an electrical impulse operated, number wheel counter according to the invention.

Referring to the drawings, an electrical impulse operated number wheel counter comprises a housing 1 formed by two generally similar parts. The housing is shown somewhat diagrammatically since the exact form plays no part in the present invention. A suitable housing is shown in UK Patent Application No. 7943213 (Publication No. 2 039 398 A) to which reference is directed.

A series of coaxial number wheels 2 are freely rotatably mounted on a first shaft 3, ends of which engage in respective blind apertures in the housing 1. The number wheels 2 are of known form, having on opposite sides thereof a ring of gear teeth 4 and a generally smooth ring 5 provided with a single transfer element 6. Extending parallel with the first shaft 3 is a second shaft 7—similarly located in the housing—on which are freely rotatably mounted transfer pinions 8, each provided at one side thereof with an integral boss 9, the exact form and purpose of which will be described hereinafter. In conventional manner, each transfer pinion is provided with alternating full and half width teeth, there being in this example five of each. All the teeth of each pinion 8 mesh with the gear teeth 4 of one of the adjacent number wheels and the transfer element 6 on the other of the adjacent number wheels engages the full width pinion teeth once per revolution of that number wheel to drive that pinion through an angle sufficient to drive the teeth 4 of the number wheel with which that pinion is engaged by the amount necessary to effect a count of that number wheel. At an end of the second shaft 7 there is freely rotatably mounted thereon a pawl 12 having drive elements 13 and 14 and a slot 15 which extends generally radially of the second shaft 7. As further described hereinafter, the pawl 12 is reciprocally rotated to effect a count. On reciprocation of the pawl 12, movement in one sense of the pawl effects engagement between the drive element 13 and teeth 16 formed on the first wheel of the series of number wheels to rotate the wheel through a first half of the angle required to effect a count, whilst the reverse rotation of the pawl 12 causes the drive element 14 to engage the teeth 16 and rotate the first number wheel through the second half of the angle required to effect the count. The teeth 16 on the first wheel of the series of wheels 2 are, it will be appreciated, ratchet teeth which are engaged by the pawl 12 whereas the gear teeth 4 on the remaining wheels 2 are shaped to mesh with the transfer pinions 8.

Figure 2:
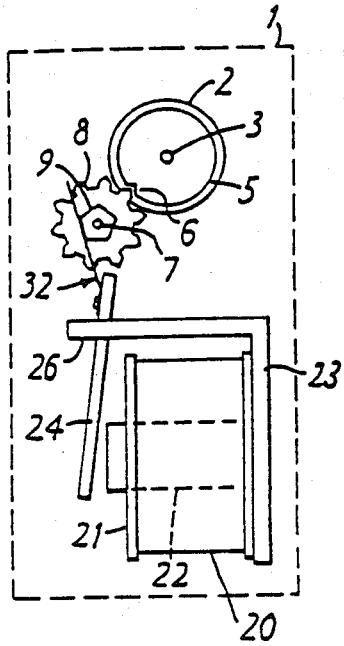
FIG. 2 is an opposite side elevation of the counter of FIG. 1.

Electrical impulse actuated means of the counter comprises a solenoid 20 provided on a bobbin 21. The bobbin 21 threads over a solenoid core 22 which projects from an L-shaped frame 23 mounted within the housing. The mounting of the frame 23 can take a variety of forms but is preferably as shown in the aforementioned UK Patent Application. The magnetic circuit of the solenoid 20 is formed by the core 22 and the frame 23 and is completed by an armature 24 pivotally mounted on the free edge of the part of the L-shaped frame 23 which projects parallel to the solenoid core 22. The pivotal mounting of the armature 24 is effected by means of notches 25 in the armature which engage respective opposite ends of a rectangular recess 26 formed in the frame 23. The frame 23 is further provided with a spring anchor 27 between which and a similar anchor 28 provided on the frame 23, is connected a helical biassing spring 29 which—when the solenoid 20 is deenergized —holds the armature 24 out of engagement with the core 22 of the solenoid. Whenever the solenoid is energized by a count pulse, the armature is attracted to the solenoid core, so stressing the spring 29. When the solenoid is de-energized, a spring 29 returns the armature to the position (shown in FIG. 2) where it is out of engagement with the core 22.

At the side thereof adjacent the pawl 12, the armature 24 is formed with a lug 30 which projects within the slot 15 of the pawl so that whenever the armature is reciprocated as a result of a current pulse passing through the solenoid 20, reciprocation of the pawl 12 takes place to register a count on the first number wheel. It will be seen that the reciprocation of the armature 24 effects reciprocal movement in an opposite sense of the pawl 12.

Figure 3:
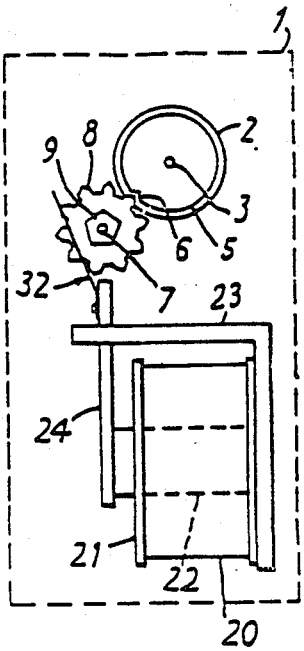
FIG. 3 is a view similar to FIG. 2 with the parts shown in a different position.

Carried upon the armature 24 is leaf spring means 32 in the form of a series of parallel leaves 33 extending between an integral support plate 34 which is riveted to the armature and an integral bridge piece 35. The leaves 33 cooperate respectively with the bosses 9 of the transfer pinions, these bosses being of polygonal cross section with the number of flats equalling the number of discrete positions adopted by the transfer pinions - in this case five. In the rest position, with the solenoid deenergized, (see FIG. 2) the leaves engage the respective bosses and are stressed by this engagement. It will be appreciated that the individual pinions are positively held against rotation and much improved alignment of the number wheels is achieved. When the solenoid is next energized, the effect of the armature moving toward the solenoid core 22 is to retract the leaves 33 from the respective bosses 9 leaving the transfer pinions free to rotate as required for counting. During counting, therefore, the number wheels 2 and the transfer pinions 6 are able to rotate unhindered by the leaf spring means. As the armature returns to its rest position the leaves re-engage the flats of bosses during which engagement any mis-alignment of the transfer pinions is corrected. In addition to serving the purpose of aligning the number wheels it is found that the leaf spring means 32 significantly reduces the power consumption of the counter. By way of explanation of this effect it can be seen that as the armature is moved under the action of the solenoid from the position shown in FIG. 2 to that shown in FIG. 3, the resilient energy held in the stressed leaf springs will assist the movement of the armature, effectively helping to overcome the static inertia of the mechanism. The leaf spring means thus reduces power consumption at any rate of operation specified in terms of minimum time interval between successive pulses.

Figure 4:
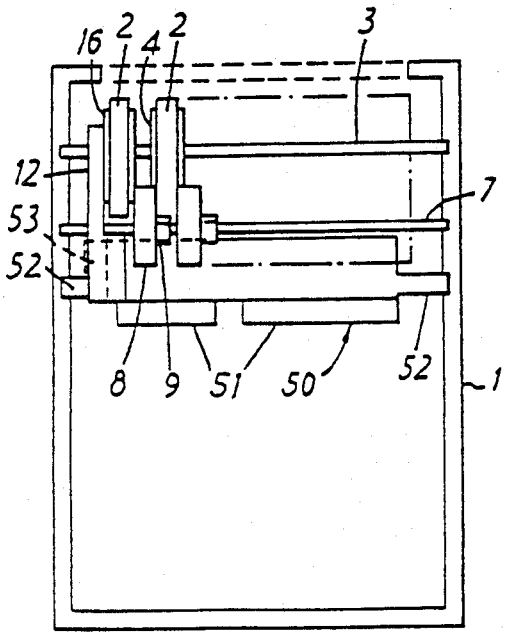
FIG. 4 is a plan of the counter of FIG. 1.
Figure 5:
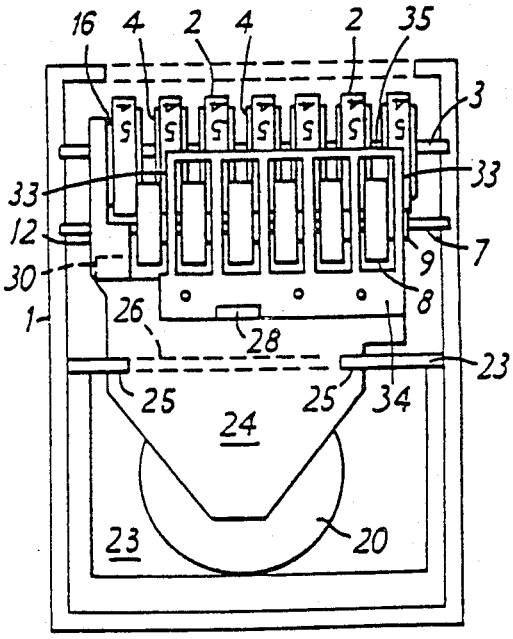
FIG. 5 is a view similar to FIG. 4 with certain parts removed for the sake of clarity.

As best shown in FIGS. 1 and 4 a shock resistance member 50 is provided in the counter, extending generally parallel to the number wheel and transfer pinion shafts. The element 50 is an integral plastics moulding and can be seen to comprise a body portion 51 having a quadrant shaped cross section, end spigots 52 and an operating lug 53. In the assembled counter, the spigots 52 are located in blind apertures of the housing and abutments (not shown) provided in the housing limit the angular movememt of the member. In this manner the shock resistance member is pivotally and eccentrically mounted for free oscillation within limits about an axis parallel to that about which the pawl 12 pivots during counting. As can be seen, the operating lug 53 underlies the drive element 14 of the pawl.

The purpose of the shock resistance member 50 is to eliminate spurious counts resulting from shock induced movements of the armature 24 and pawl 12. In the event of a shock causing pawl 12 to rotate in a direction which would cause drive element 13 to impart movement to the ratchet teeth 16, the lug 53 of the shock resistance member will collide with the drive element 14 the member 50 having itself been set into oscillatory motion by the same shock, but at a much greater frequency that the interconnected pawl and armature, due to the absence of any movement inhibiting elements such as helical spring 29. The effect of the shock resistance member colliding with the pawl is to bring the pawl to rest by absorbing its energy thus preventing a count being made. Since there is no direct connection between the pawl and the shock resistance member, the effect of the shock resistance member upon the power consumption of the counter during normal operation is negligible.

The invention has been described by way of example only and numerous modifications are possible without departing from the scope of the invention as defined in the appended claims.

Thus, although the described leaf spring means includes a plurality of leaves one for each transfer pinion, a reasonable degree of alignment can be achieved with a single leaf spring engaging only the last transfer pinion remote from the drive pawl. As explained previously, the maximum possible mis-alignment increases progressively from the first to the last transfer pinion and if the last transfer pinion is correctly aligned, the misalignment of the intermediate pinions is very much reduced. It will be appreciated that, however many leaves are provided, these could be arranged to engage the number wheels directly rather than the transfer pinions. Similarly, elements other than leaf springs could be used to form the alignment means; an example being rigid toothed arms meshing, in the rest position, with the teeth of the number wheels. Whatever arrangement is employed, it is essential that the alignment means be displaced momentarily as the drive means is actuated so that rotation of the number wheels and transfer pinion is not hindered during counting. In an electrical impulse operated counter, the most convenient arrangement is to mount the alignment means directly on the armature. The alignment means could however be mounted on another element of the drive means or could be separately mounted in the housing in a manner so as to be engageable with the armature or some other element of the drive means.

In electric impulse operated counters, if the alignment function of the leaf spring means is for some reason not required, the described reduction in power consumption can be achieved with the leaf spring means engaging a part of the counter other than the number wheels or transfer pinions. The leaf spring means could for example engage, in the rest position of the armature, an abutment provided on the housing. In appropriate case, the leaf spring might even be mounted on the housing so as to engage an abutment formed on the armature. Indeed, spring means other than a leaf spring could be employed, for example a second helical spring or an appropriately positioned block of foamed plastics material.

Modifications can similarly be made to the described shock resistance member. This could be mounted in the path of a drive element other than the pawl, such as - in the example of an electric impulse operated counter - the armature. The shape of the member would be adapted to suit counters having a different configuration and other forms of mounting of the member can be employed, if desired.

I claim:

1. A counter comprising (A) a plurality of successive coaxial number wheels;

(B) a different ring of gear teeth on each number wheel;

(C) a different transfer means on each number wheel;

(D) transfer pinions respectively disposed intermediate successive number wheels (i) each pinion meshing with a ring of gear teeth on one of the number wheels adjacent thereto and adapted to engage transfer means on the preceding number wheel during rotation of said preceding number wheel thereby partially to rotate said one of the number wheels;

(E) drive means intermittently actuable to rotate a first one of the number wheels thereby to effect counting of the counter; and (F) alignment means disposed in a rest position to operatively engage at least the last number wheel through the transfer pinion in mesh therewith thereby to inhibit rotation of said number wheel between counts, (i) the alignment means being momentarily displaced from said rest position upon each actuation of the drive means to enable unhindered rotation of the number wheels during counting, (ii) the alignment means comprises leaf spring means carried upon a reciprocating element of the drive means.

2. A counter according to claim 1, characterised in that the alignment means is arranged in the rest position to operatively engage each number wheel through a transfer pinion in mesh therewith, thereby separately to align the number wheels.

3. A counter according to claim 1, characterised in that the transfer pinions include respective integral bosses formed with flats equal in number to the number of discrete angular positions adopted by the transfer pinions, said leaf spring means comprising separate leaves respectively engaging the flats.

4. A counter according to claim 2, wherein the drive means includes a solenoid and a reciprocating armature, characterised in that the alignment means is carried on the armature.

5. An electric impulse operated counter comprising a plurality of coaxial number wheels; transfer pinions respectively disposed intermediate successive number wheels, each pinion meshing with gear teeth on one of the number wheels adjacent thereto and adapted to engage transfer means on the other number wheel during rotation of said other number wheel thereby partially to rotate said one of the number wheels; reciprocally movable pawl means adapted when actuated to rotate a first one of the number wheels to effect counting of the counter and electrical impulse actuated means having a solenoid, an armature supported for reciprocal movement and engaging the pawl means to effect reciprocal movement thereof when an electrical impulse energizes the solenoid and spring means serving to return the armature to a rest position when the solenoid is de-energized, characterised in that there is provided an additional spring means cooperating between the armature and a part of the counter so as to be stressed upon said return movement of the armature, energy in said stressed spring means assisting in movement of the armature when the solenoid is next energized.

6. An electric impulse operated counter according to claim 5, characterized in that the additional spring means is carried on the armature.

7. An electric impulse operated counter according to claim 5 or claim 6, characterized in that the additional spring means comprises leaf spring means.

8. A counter comprising (A) a plurality of successive coaxial number wheels;

(B) a different ring of gear teeth on each number wheel;

(C) a different transfer means on each number wheel;

(D) transfer pinions respectively disposed intermediate successive number wheels;

(i) each pinion meshing with a ring of gear teeth on one of the number wheels adjacent thereto and adapted to engage transfer means on the preceding number wheel during rotation of said preceding number wheel thereby partially to rotate said one of the number wheels; and (E) drive means intermittently actuable to rotate a first one of the number wheels thereby to effect counting of the counter;

(i) characterised in that there is provided (F) a shock resistance member freely movable relative to an element of the drive means and so positioned as to oscillate freely in the path of said element in the event of a shock tending to cause movement of the element, the shock resistance member thereby serving to interfere with shock induced movement of the element to inhibit shock induced operation of the counter, but offering negligible resistance to movement of the drive means in normal counting, wherein the drive means includes reciprocally movable pawl means, characterised in that the shock resistance member is positioned as to oscillate freely in the path of said pawl means.

9. A counter according to claim 8, characterised in that the shock resistance member is eccentrically mounted for oscillatory movement about an axis parallel to the axis about which the pawl means is reciprocally movable.

* * * * *